US007815183B2

(12) United States Patent
Cappello et al.

(10) Patent No.: US 7,815,183 B2
(45) Date of Patent: Oct. 19, 2010

(54) COMPACT STRUCTURE DEVICE FOR EXTRACTING SHEETS FROM TWO TRAYS AND RESPECTIVE PRINTER

(75) Inventors: Paolo Cappello, Ivrea (IT); Daniele Mazzini, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 131 days.

(21) Appl. No.: 11/658,855

(22) PCT Filed: Jul. 13, 2005

(86) PCT No.: PCT/EP2005/007603

§ 371 (c)(1),
(2), (4) Date: Jan. 29, 2007

(87) PCT Pub. No.: WO2006/010478

PCT Pub. Date: Feb. 2, 2006

(65) Prior Publication Data

US 2008/0315501 A1 Dec. 25, 2008

(30) Foreign Application Priority Data

Jul. 28, 2004 (IT) ..... TO2004A0526

(51) Int. Cl.
*B65H 3/44* (2006.01)

(52) U.S. Cl. ..... 271/9.07; 271/110; 271/119; 271/116

(58) Field of Classification Search ..... 271/9.07, 271/9.12, 9.13, 110, 118, 119, 245, 116
See application file for complete search history.

(56) References Cited

U.S. PATENT DOCUMENTS 4,577,849 A 3/1986 Watanabe
4,896,871 A 1/1990 Idenawa (Continued)

FOREIGN PATENT DOCUMENTS

| | | | |
|---|---|---|---|
| EP | 0 832 833 | A2 | 4/1998 |
| EP | 0 918 028 | A1 | 5/1999 |
| JP | 60-258029 | A | 12/1985 |
| JP | 61-257843 | A | 11/1986 |
| JP | 64-28134 | A | 1/1989 |
| JP | 05 116784 | A | 5/1993 |
| JP | 7-330182 | A | 12/1995 |

OTHER PUBLICATIONS

International Search Report dated Oct. 19, 2005, issued in PCT/EP2005/007603.

(Continued)

*Primary Examiner*—Kaitlin S Joerger
(74) *Attorney, Agent, or Firm*—Venable LLP; Robert Kinberg; Steven J. Schwarz

(57) ABSTRACT

A device (10) for extracting and feeding sheets from two trays, comprising a first tray (20) to contain a first ream (21*a*) of sheets (21), a second tray (30) to contain a second ream (31*a*) of sheets (31), and a feeding member (50, 53, 53*a*, 53*b*) for extracting and feeding one sheet (21, 31) at a time from said first ream (21*a*) or from said second ream (31*a*), wherein the two trays (20, 30) are positioned one on top of the other on the same side of the feeding member (50), and the second tray (30), in an intermediate position between the first tray (20) and the feeding member (50), comprises a fixed wall (32, 32*a*, 32*b*), to support the second ream (31*a*), which is configured in order to define an opening or cooperation zone (41) between the first tray (20) and the feeding member (50), so that, when the second ream is not present in the second tray (30) the feeding member (50, 53, 53*a*) and the first ream (21*a*) are intended to cooperate in contact with each other, through said cooperation zone (41) in order to extract and feed a sheet (21) from the first ream (21*a*) contained in the first tray (20). The device of the invention has a compact, inexpensive structure and is realized with a limited number of parts, and guarantees an accurate and silent functioning, reliable in time.

15 Claims, 10 Drawing Sheets

U.S. PATENT DOCUMENTS

| | | | | |
|---|---|---|---|---|
| 5,738,454 | A | 4/1998 | Zepeda et al. | |
| 5,775,684 | A | 7/1998 | Jackson et al. | |
| 5,876,032 | A * | 3/1999 | Kato | 271/114 |
| 6,022,013 | A | 2/2000 | Foglino et al. | |
| 6,045,220 | A | 4/2000 | Kiyohara et al. | |
| 6,070,867 | A * | 6/2000 | Tsurumi et al. | 271/114 |
| 6,688,590 | B2 | 2/2004 | Billings et al. | |
| 6,709,177 | B1 | 3/2004 | Sugimura | |

OTHER PUBLICATIONS

Patent Abstracts of Japan vol. 013, No. 206, May 16, 1989.
Patent Abstracts of Japan vol. 011, No. 114, Apr. 10, 1987.
Patent Abstracts of Japan vol. 1996, No. 04, Apr. 30, 1996.
Patent Abstracts of Japan vol. 017, No. 486, Sep. 3, 1993.
Patent Abstracts of Japan vol. 010, No. 134, May 17, 1986.

* cited by examiner

COMPACT STRUCTURE DEVICE FOR EXTRACTING SHEETS FROM TWO TRAYS AND RESPECTIVE PRINTER

FIELD OF THE INVENTION

The present invention refers in general to a device for feeding sheets, and in more detail, for extracting and feeding sheets from two separate trays, specifically adapted for incorporation in an office machine, such as a fax transmission machine of the type comprising a printing unit and a reading unit for the reception and transmission of documents, respectively.

TECHNICAL BACKGROUND OF THE INVENTION AND KNOWN STATE OF THE ART

As it is known, fax machines are connected to an external communication line for receiving and transmitting documents through it.

The data on the documents, once they have been received through the line, are printed by a printing unit in the fax machine on blank sheets, which in turn are generally extracted from a first tray containing a certain supply of such sheets.

The documents to be transmitted, also referred to as original sheets or documents, are stored in a second tray, from which they are extracted to be read by the fax machine, and thus converted into data that is successively transmitted through the line.

The tray, in which the blank sheets to be printed are contained, and the relative devices for the extraction of the sheets from the tray form a group briefly referred to as ASF, acronym of the English expression "Automatic Sheet Feeder".

The tray, in which the original sheets of the documents to be transmitted are contained, and the relative devices for the extraction of such sheets from said tray form a group briefly referred to as ADF, acronym of the English expression "Automatic Document Feeder".

The two trays that contain the blank sheets to be printed and the original sheets to be read, respectively, together with the relative devices adapted for the extraction of the sheets form a group that represents an important aspect of a fax machine, which influences both the performance and the cost of the fax machine to a considerable extent.

Above all it is important that this group is able to ensure highly precise, accurate and reliable extraction of the sheets from the trays one at a time, and that it is of a simple construction in order to have the least possible influence on the overall cost of the total fax machine.

A device is already known, from the U.S. Pat. No. 6,022,013 adapted for assembly on an office machine, such as a fax or printer for example, which is intended to selectively feed sheets contained in two separate trays by means of a pick-up unit positioned between the two trays.

In particular in this device, the two trays are fulcrum-mounted on a fixed structure and are activated alternatively by a motor, according to the respective rotation direction, in a manner so that they selectively approach the pick-up unit, thus causing the separation and feeding of one sheet at a time from one or the other of the two trays.

However, the Applicant has observed that this device has the drawback of having a rather complex structure, and thus expensive, and that it is furthermore conditioned by the fact that both trays need to be moved in order to bring the respective sheets in a position to cooperate with the pick-up unit.

In fact the movements to approach and move away the two trays with respect to the central pick-up unit, because of the trays mass, provoke dynamic stress that can sometimes have a negative effect on the performance and efficiency of the picking-up of the sheets, and in extreme cases, even compromise the stability of the sheets in the respective trays.

Also known through U.S. Pat. No. 6,688,590, is a printer having two trays for containing two corresponding reams of sheets of paper, and an extraction device positioned between the two trays to selectively extract sheets from one or the other of the trays.

The extraction device is composed of a drive shaft and an extraction member having an arm structure that rotates around a fixed axis, and intended to be driven by the drive shaft to determine the extraction of the sheets.

When in use, the extraction member oscillates around the fixed axis, to move between the two trays and to engage one or the other of the reams of sheets contained in the two trays, operating in a manner so that when the drive shaft rotates in a first rotation direction, the extraction member engages and extracts a sheet from a first ream, and when the drive shaft rotates in a second opposite rotation direction, the extraction member engages and extracts a sheet from the second ream of sheets.

The Applicant has observed that in said extraction device of sheets from two trays, the extraction member has a rather complex structure and furthermore, is not easily controllable because of the arm and projecting shape.

Also known through U.S. Pat. No. 6,709,177 is a device applied to a photocopying machine for extracting and feeding sheets from two trays, positioned one on top of the other, wherein each of the two trays is associated with a respective leafing roller for extracting and feeding one sheet at a time from a ream of sheets contained in the corresponding tray.

In this case as well, the Applicant has observed that the extraction and feeding device for the sheets from the two trays has the drawback of having a rather complex structure, and therefore expensive, especially because of the presence of a specific and separate feeding roller for each one of the trays.

SUMMARY OF THE INVENTION

The Applicant faced the problem of providing a device for separating and feeding the sheets from two trays that is be able to overcome the aforesaid drawbacks of the state of the art, and in particular, that has a simple structure with a reduced number of parts, wherein, the two tray system is such as to involve reduced masses to be moved during operation, as well as movements of parts as limited as possible so as to prevent the arising of considerable inertial stresses.

The Applicant has also perceived the problem of providing a device for extracting and feeding sheets from two trays, that is suitable to be advantageously used in a fax machine for feeding blank sheets to be printed and sheets containing data to be transmitted towards a printing unit and a reading unit of the fax machine, respectively, and that it is, in particular, able to realise these functions in a reliable and precise manner by means of a simple structure composed of a limited number of parts subjected to relatively reduced movements.

In view of said problems, the present invention concerns in a first aspect, a sheet extraction and feeding device comprising:

a first and a second tray adapted to contain respectively a first and a second ream of sheets, a feeding member to grip and pull a sheet from one of the first or second ream of sheets, wherein the second tray is positioned between the first tray and the feeding member, and the feeding member and the first ream are adapted to cooperate through said second tray.

Preferably, in the sheet extraction and feeding device according to the invention, the second tray forms an opening to allow, in the absence of the second ream in the second tray, the feeding member and the first ream contained in the first tray to reciprocally cooperate in an engagement or contact relationship.

Still preferably, this, opening formed by the second tray is such as to allow the first tray, in the presence of the second ream in the second tray, to operate on the second ream for pressing it and maintaining it engaged against the said feeding member.

According to a further aspect, the present invention concerns a method for feeding sheets from a first or second ream, wherein the method comprises the following steps:

housing at least one of the first and second reams respectively in a first and a second tray, the second tray being positioned above the first tray;

extracting a sheet from one the first and second ream by means of a feeding member; and selectively extracting a sheet from the second ream in the presence of the same second ream in the second tray, or extracting a sheet from the first ream in the absence of the second ream in the second tray;

wherein the extraction step of a sheet from the first ream comprises the step of making the feeding member cooperate with the first ream through the second tray.

BRIEF DESCRIPTION OF THE DRAWINGS

These and other characteristics, aspects and aims of the invention will be made more clear by the following description of an embodiment, provided as a non limiting example with reference to the figures in the appended drawings wherein.

DETAILED DESCRIPTION OF A PREFERRED EMBODIMENT OF THE INVENTION

With reference to FIGS. 1-4, a device to extract and feed sheets from two trays, hereafter briefly referred to also as leafing device, realised according to the present invention, is identified as a whole by the numeral 10.

The leafing device 10 of the invention is incorporated in an office machine, such as a fax machine 11, hereafter simply referred to also as a fax, having a fixed structure 16 and connected to an external communication line for the reception and transmission of documents.

Figure 1:
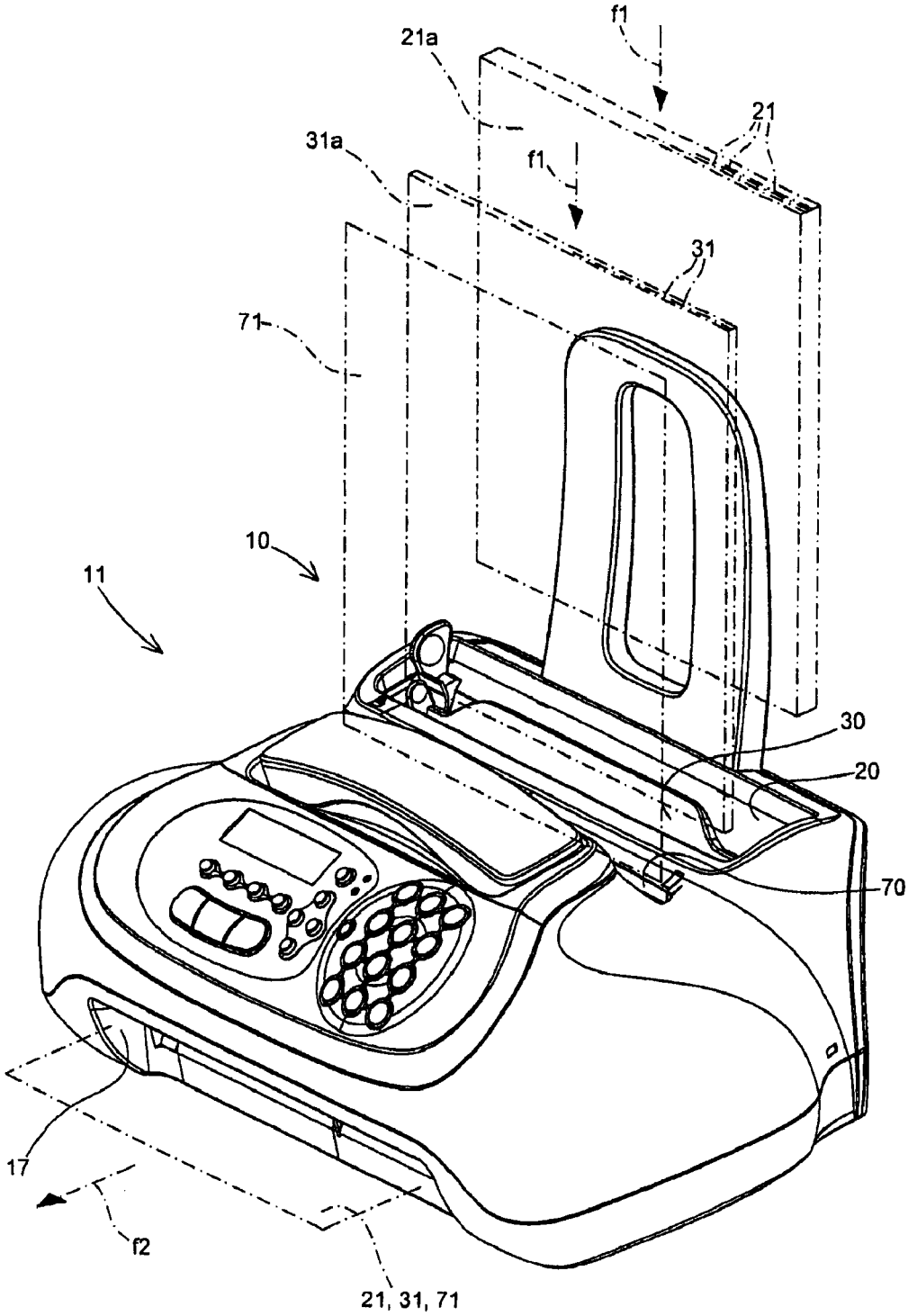
FIG. 1 shows a first perspective view of a fax machine that incorporates a leafing device to extract and feed sheets from two trays, realised according to the present invention.
Figure 2:
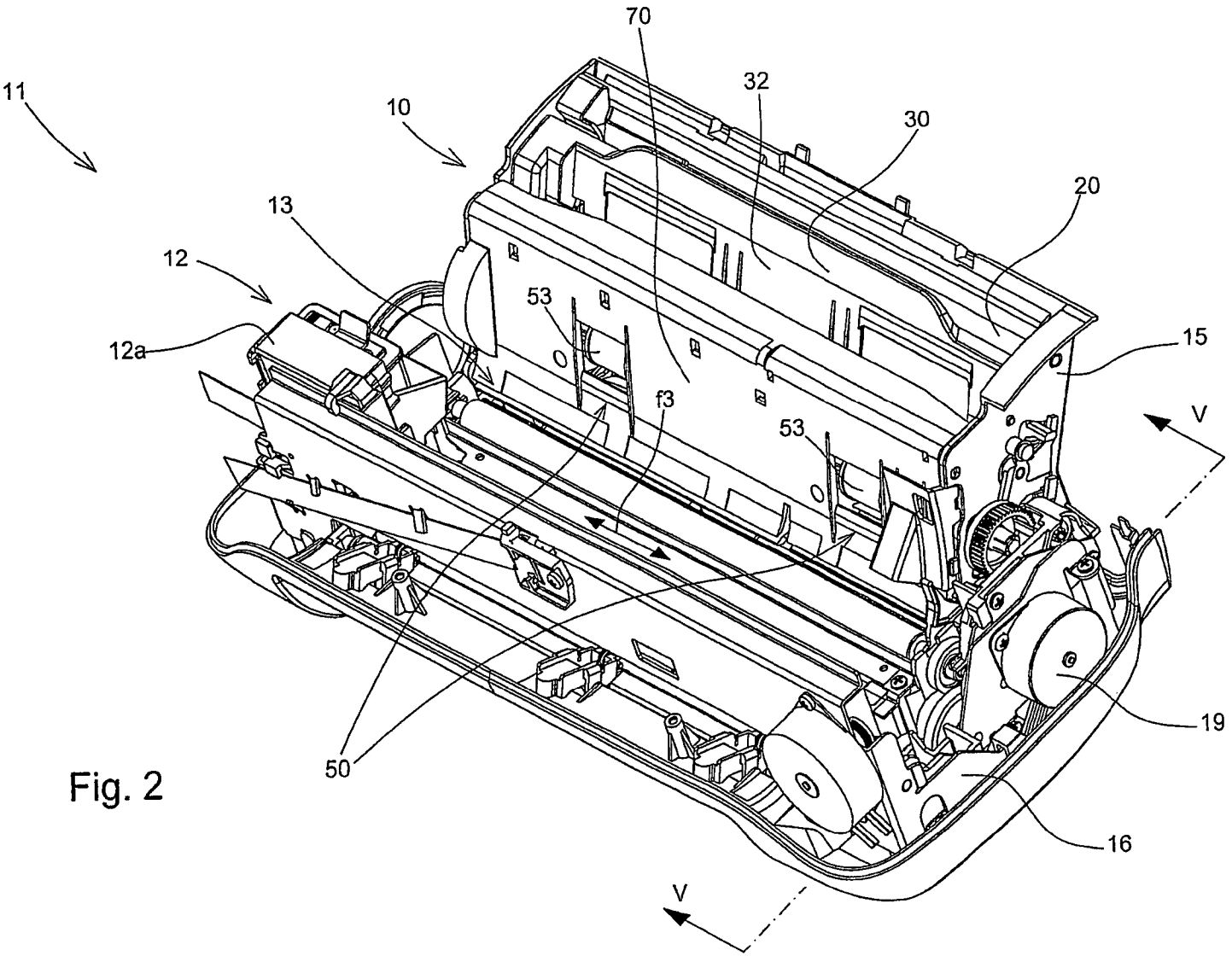
FIG. 2 shows a second perspective view of the fax machine in FIG. 1, without its external case.
Figure 3:
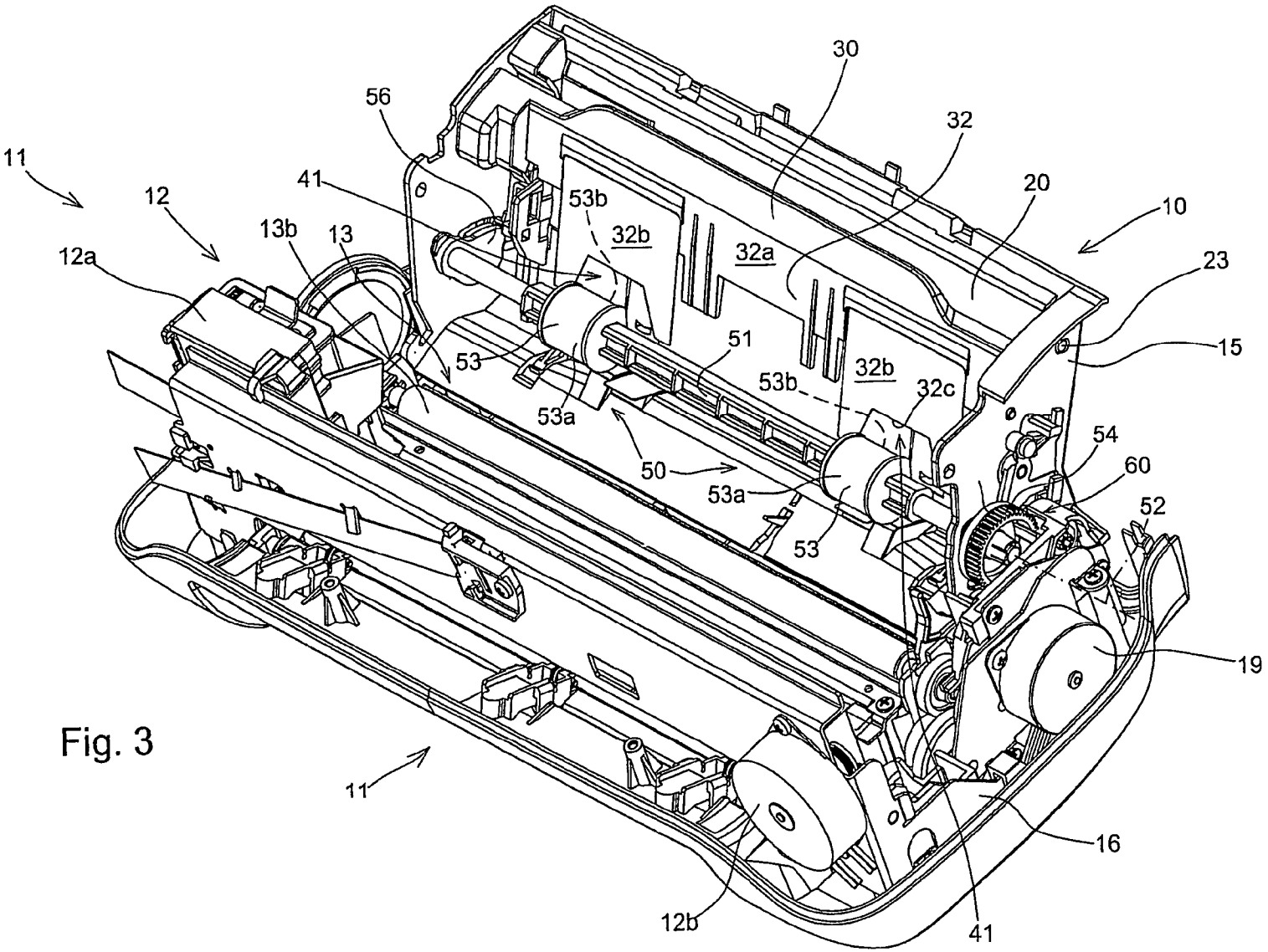
FIG. 3 is a further perspective view of the fax machine in FIG. 1, with certain parts removed; in order to show the leafing device of the invention.

As shown in FIG. 1, and more clearly in the cross-sections of FIGS. 7*a*-7*d*, the separating and feeding device 10 performs both the function of containing a first plurality or first ream 21*a* of sheets 21, and a second plurality or second ream 31*a* of sheets 31, and of separating and feeding the sheets 21 and 31 selectively one at a time from the respective reams 21*a* and 31*a*.

For this aim, the leafing device 10 comprises a first and a second tray 20 and 30, distinct from each other, intended to contain the first ream 21*a* and the second ream 31*a* respectively.

In particular, for use in the fax 11, the sheets 21 that form ream 21*a* contained in tray 20 are composed of blank sheets for printing the received documents, while the sheets 31 that form ream 31*a* contained in the second tray 30, are composed of sheets bearing images texts or other data, and that form the documents to be transmitted by the fax machine 11.

Preferably tray 20 has a larger capacity than that of tray 30, and correspondently, ream 21*a* will be composed of a larger number of sheets than ream 31*a*.

For example the trays 20 and 30 can be sized so that tray 20 is prearranged to contain a number of sheets sufficient for printing the maximum number of documents (each document, being in turn composed of a certain number of sheets) that would be normally foreseen to be received during an established period of time, for example during one day, while prearranging tray 30 to contain a single document, in turn composed of one or more sheets, to be transmitted alone, or at the most, to contain only few documents to be transmitted together.

As a concrete example, the ream 21*a* is composed of a maximum of 40-50 sheets, to be used for printing, while the ream 31*a* is composed of 5-10 sheets, to be transmitted.

Naturally in the case of differing needs, said trays can be sized accordingly.

Again, in the context of the general fax operating function 11, the sheets 21 and 31 extracted and fed selectively by means of the leafing device 10 from the corresponding trays 20 and 30, are conveyed along a common feeding path 18, shown by the dashed and dotted line in FIGS. 7*a*-7*d*, coherent with a feeding direction 18*a* (FIG. 4) to respectively cooperate with a printing unit 12 and a reading unit 13 of the fax machine 11, as will be explained more clearly further on.

The printing unit 12 and the reading unit 13 of fax 11, arranged along the feeding path 18, have known characteristics and for this reason they will be only described briefly, and simply with respect to those aspects that may be necessary for the description of the present invention.

The printing unit 12, for example, comprises a printing head 12*a*, in particular of the ink jet type, which is adapted to be driven by a translation motor 12*b* to translate backwards and forwards along a printing zone as shown by a double arrow f3 (FIG. 2), in order to successively print a plurality of print lines on a blank sheet 21, coming from the first tray 20, as it travels along the path 18.

The reading unit 13 comprises in particular a reading bar 13*a*, often referred to by the term CIS (English acronym for Contact Image Sensor) that extends along the whole width of a document sheet 31 coming from tray 30, and intended to receive, cooperating in a pressure relationship with a rotating traction roller 13*b*, the same document sheet 31, so that it can be read line by line as it travels progressively along the path 18.

In order to feed the sheets 21 and 31 along the feeding path 18, the fax 11 comprises suitable feeding means, generally identified by the numeral 14, and including for example, as well as rotating roller 13*b* associated with the reading bar 13*a*, one or more rotating rollers or members 14*a*, coupled with each other. These rotating rollers 14*a* are adapted to receive and to cooperate in contact with the sheets 21 and 31, coming from trays 20 and 30 respectively, to feed them before the reading unit 13 and the printing unit 12, and lastly, to expel them outside the fax machine 11 through an exit zone or opening 17, coherent with the direction shown by an arrow f2 (FIG. 1).

In detail, the leafing device 10 comprises, as well as the trays 20 and 30, already described previously, a fixed support structure 15, intended to support the various fixed and mobile parts of the leafing device 10, which is integrated and attached to the fixed structure of the fax 11; a main drive motor 19; a leafing or feeding member 50; and a driving mechanism 60, of the rocker type, as will be described in more detail further on, interposed between the main drive motor 19 and the leafing member 50.

As stated previously, the first tray 20 is intended to contain the first plurality of blank sheets 21, hereafter also referred to as copy sheets used for printing data of the document, to be reproduced, received from the fax 11, and is positioned, along a back side of the fax 11, further from the leafing member 50 than the second tray 30.

In turn the second tray 30, as stated previously, is intended to contain the sheets 31 already having printed data, and for this reason also referred to as original sheets or document sheets, that form the sheets of the document to be read and transmitted by means of the fax machine 11, and is positioned between the first tray 20 and the leafing member 50, i.e. positioned closer to said member than the first tray 20.

In short, the two trays 20 and 30 are positioned one in front of the other and on the same side with respect to the leafing member 50, with the first tray positioned further from the leafing member 50, and moreover, with both trays 20 and 30 open at the top and sloping with respect to a horizontal plane in order to be able to receive from the top, in the direction shown by arrows f1 (FIG. 1), and to contain in a stable manner the relative reams of sheets 21*a* and 31*a* subjected to their own weight.

In particular the first tray 20 comprises a mobile plate or wall 22 (FIGS. 4 and 5) also called bottom, which is fulcrum-mounted on the fixed structure 15 at a fulcrum 23, and adapted to act as a support along its extension for the first ream 21*a* contained in tray 20.

The mobile wall 22 of the first tray 20 is also associated with elastic means 25 (FIG. 7*a*) for example composed of one or more springs, indicatively of the helical compression type, interposed between the fixed structure 15 and the same mobile wall 22, which are adapted to apply an elastic force on the mobile wall 22 to press it constantly in the direction of the leafing member 50.

The second tray 30 comprises a fixed respective wall 32 that in turn defines a support surface for the second ream 31*a* contained in the second tray 30.

In particular, the wall 32 comprises a first part 32*a* that is integral with the fixed structure 15 and that extends along a sloped plane basically parallel to that of the mobile wall 22 of the first tray 20, and a second part composed of two support plates 32*b* that are fixed to the first part 32*a* and that extend in a downward direction on the same slope in order to extend the support surface for ream 31*a*.

These plates 32*b* are realised in a material such as rubber, having a high friction coefficient with respect to the sheets 31, and in any case higher than the friction coefficient between the sheets 31 that compose ream 31*a*.

In this manner, according to known measures and expedients, these support plates 32*b* act to retain, thanks to their higher friction coefficient, the end or last sheet of the ream 31*a* lying on the wall 32 of the tray 30, so as to prevent the risk of feeding two sheets to coincide with the extraction of said last sheet.

A striking surface 24 (FIG. 7*a*-7*d*) defines a common lower bottom for the trays 20 and 30, and is intended to cooperate in contact with the lower ends of the ream 21*a* and ream 31*a*, in order to support ream 21*a* and ream 31*a* from underneath, when they are contained in the respective trays 20 and 30.

A driving or retaining mechanism 26 (FIGS. 8*a* and 8*b*) is associated with the striking surface 24 in order to drive and accompany the lower edge of the ream 21*a* and ream 31*a* contained in the respective trays 20 and 30, during the movements of the mobile wall 22 with respect to the leafing member 50.

In particular this driving mechanism 26 comprises two levers 26*a*, having a tooth shaped end, driven by the mobile wall 22 in order to realise a retraction motion with respect to the striking surface 24, synchronised with the motion of the mobile wall 22, and which are also adapted to cooperate in contact, in side zones of the striking surface 24, with the lower edge of each of the reams 21*a* and 31*a* contained in the respective trays 20 and 30.

In this manner the two levers 26*a* maintain the reams 21*a* and 31*b* constantly adherent to the mobile wall 22 when said wall moves backwards and forwards with respect to the leafing member 50, and in particular they ensure the correct recovery of the reams 21*a* and 31*a* during the step wherein the mobile wall 22 of tray 20 is retracted with respect to the leafing member 50, following the extraction of a sheet 21 or 31 as will be described further on.

The leafing member 50, as stated previously, acts to extract and feed the sheets 21 and 31 one by one from the correspondent trays 20 and 30 and comprises in particular a shaft 51, that is rotatably supported at the extremities of the fixed structure 15 and is adapted to rotate around a respective fixed axis 52, and also, two leafing rollers 53 that are firmly mounted on shaft 51 and intended to cooperate in contact with a sheet 21' (FIG. 7*a*) or a sheet 31' (FIG. 7*c*), arranged on top of the ream 21*a* or 31*a* contained in the two trays 20 and 30, in a manner to separate it from the other sheets of the ream and feed it in a manner that will be described more clearly further on.

In detail, the two leafing rollers 53 are fixed on shaft 51 at the rubber support plates 32*b* that form the lower part of wall 32 of the second intermediate tray 30, and each has an external profile, also referred to as D-shaped or half-moon shaped, that has along the development around axis 52 of shaft 51, a first zone 53*a* defined by a portion of cylindrical surface, and a second lowered zone 53*b*, defined by a basically flat surface connected to the two extremities of the portion of the cylindrical surface 53*a*.

With this configuration, as shown in FIGS. 7*a*-7*d*, each leafing roller 53, has, when viewed sideways, an external profile defined by a circular section that corresponds with the cylindrical portion 53*a*, and a straight lowered section that corresponds with portion 53*b*.

The leafing member 50 is also equipped with a main drive gear 54 rigidly fixed to one end of the shaft 51 and adapted to be operated by the rocker driving mechanism 60.

Again, the leafing member 50 comprises two cam profiles 56 integral with the rotating shaft 51 and therefore adapted to rotate together with the shaft, said cam profiles being positioned at the sides of shaft 51 and intended to cooperate in contact with the mobile walls 22 of the first tray 20, in order to drive the oscillation action around pin 23 to counter the action exercised by the elastic means 25 that act against the same wall 22.

The drive gear 54 is equipped externally with a toothing 54*a* that extends around the circumference for an angle less than the round angle, thus defining an un-toothed peripheral portion 54*b* of the drive gear 54.

According to an essential characteristic of the invention, the separation and feeding device 10 comprises an opening 41, also called cooperating zone or space, that is defined and formed by the fixed wall 32 of the second tray 30 in a zone between the first tray 30 and the leafing member 50, and that is such that it permits the leafing member 50 and the first ream 21*a* contained in the first tray to cooperate, through the second tray 30, reciprocally in contact, in order to extract and feed one by one a sheet 21 from the ream 21*a*, when the second ream 31*a* is not present in the second tray 30.

In particular, for this purpose, the part 32*a* and the support plates 32*b* that form the wall 32 and therefore the support surface for the ream 31*a* contained in the second tray 30, are configured to leave a space free for the cylindrical surfaces 53*a* of the rollers 53 of the leafing member 50, to access and enter into contact with the uppermost sheet 21' on top of the ream 21*a* contained in the first tray 20 during the relative extraction and feeding cycle, as will be better described further on.

Figure 4:
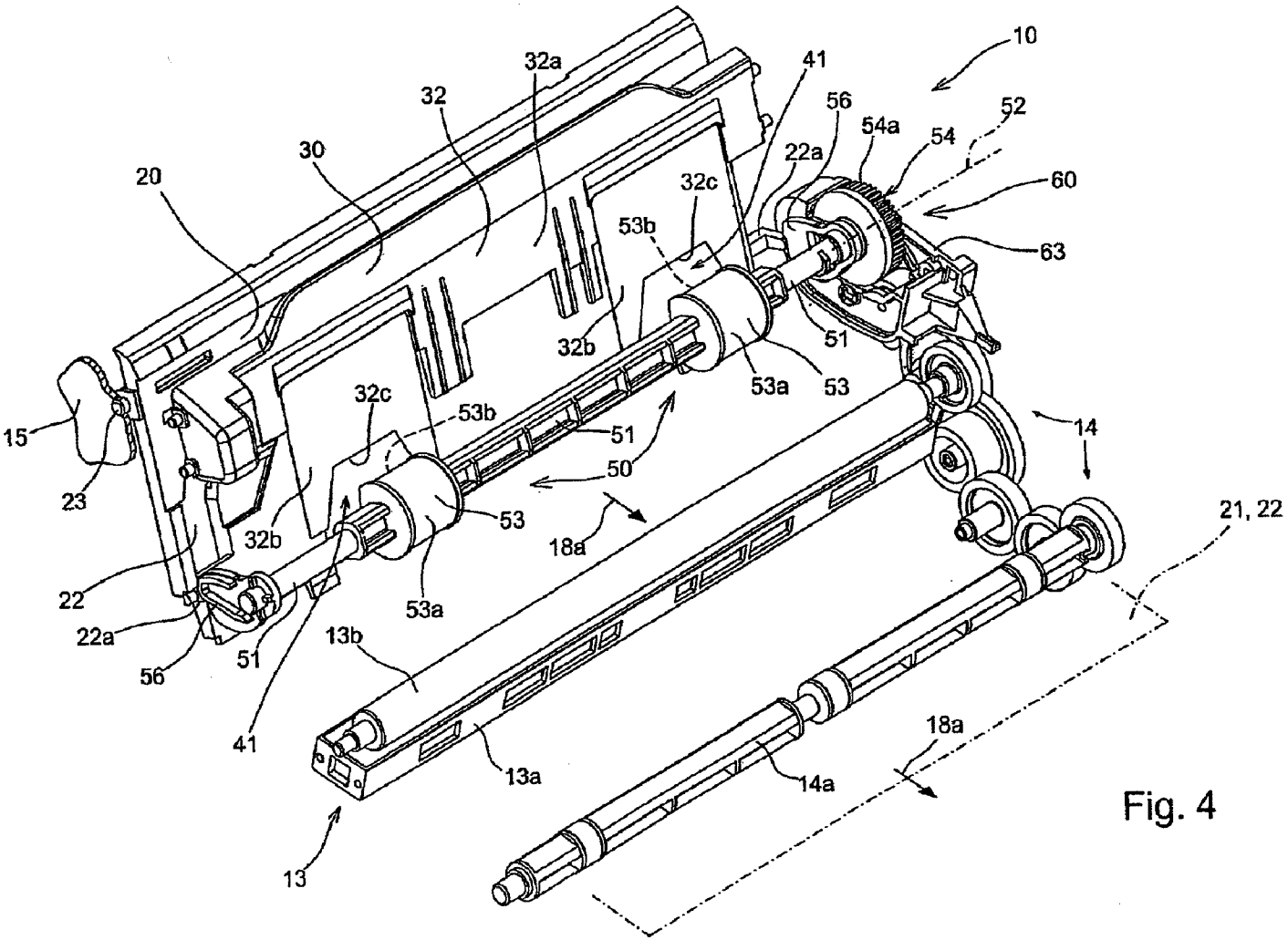
FIG. 4 shows a perspective view of certain parts of the leafing device shown in FIG. 1 and in particular a feeding member and a driving mechanism.

For example, as shown in FIG. 4, the opening 41 adapted to permit, through the second tray 30, the engagement between the leafing member 50 and the first ream 21*a*, is realised by shaping the support plates 32*b* using a profile 32*c* that corresponds with and basically reproduces the shape of the leafing rollers 53.

As will be better understood further on, the driving mechanism 60 performs the function of driving the leafing member 50 so that it rotates constantly according to a determined rotation direction coherent with the extraction of the sheets 21 and 31 from the two trays 20 and 30, as well as the function of activating and moving in synchronisation with said rotation and by means of the same leafing member 50, those parts of the extraction and feeding device 10 that are configured to separate and feed a sheet 21 or 31 selectively from one or other of the trays 20 and 30.

Figure 5:
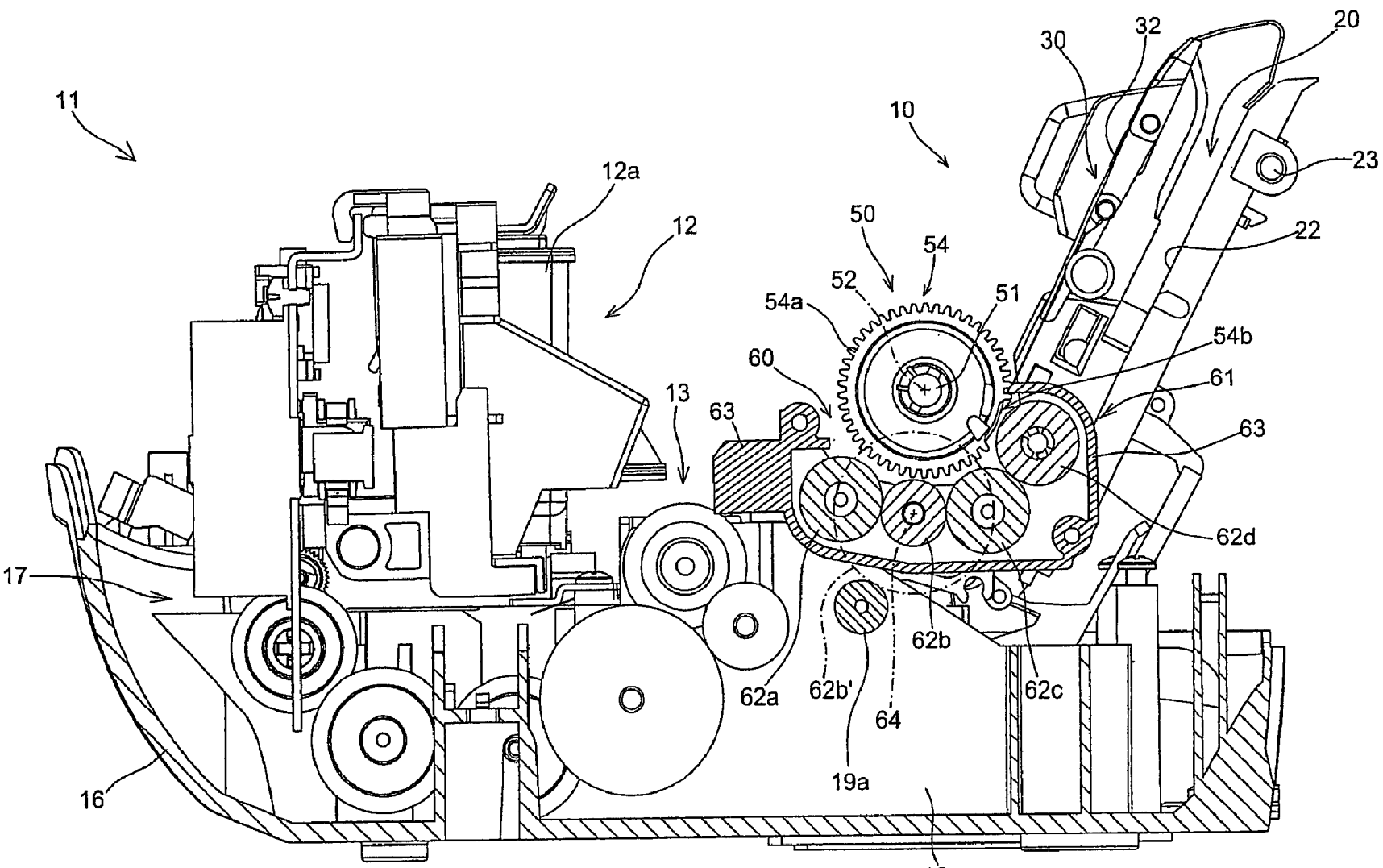
FIG. 5 is a partial cross-section side view, along a plane defined by the line V-V shown in FIG. 2 of the leafing device of the invention and the relative driving mechanism.
Figure 6:
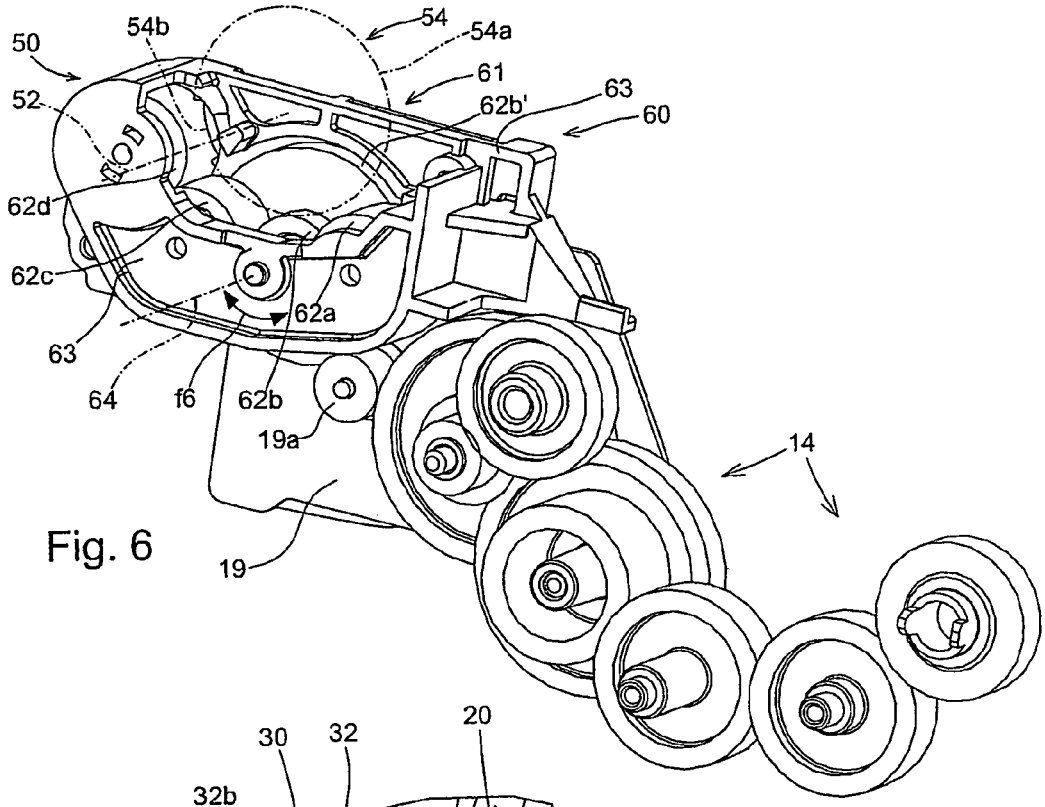
FIG. 6 shows a perspective enlarged view of the driving mechanism shown in FIG. 2.

In particular, in reference to FIGS. 5 and 6, the driving mechanism 60 is positioned along one side of the fax machine 11 corresponding with the drive gear 54 side of the leafing member 50, and is basically composed of a member 61, that acts as a rocker, and that is composed of a set of four gears or toothed wheels, respectively 62*a*, 62*b*, 62*c*, and 62*d*, arranged in a row and meshed with each other, and of a support 63, also called support lever, associated with the four toothed wheels 62*a*-62*d*.

In particular, the support 63 has a shell shape to house internally and protect the four gears 62*a*-62*d*, and in a manner similar to that of a lever, is adapted to oscillate with respect to the structure 15 of the fax machine 11 around a fixed axis 64, corresponding with the rotation axis of gear 62*b* as shown by a double arrow f6 (FIG. 6).

The toothed wheel 62*b*, also called central toothed wheel or gear, because of its central position in the set of toothed wheels 62*a*-62*d*, rotates around the respective fixed axis 64, on the fixed structure 15, and forms a first toothing, of smaller diameter, of a toothed wheel with double toothing, which in turn comprises a second toothing 62*b*', with a larger diameter meshed with a pinion 19*a* of the driving motor 19.

The other three toothed wheels 62*a*, 62*c*, and 62*d*, the first positioned on the left hand side of the central toothed wheel 62*b*, and the other two positioned on the right hand side of the toothed wheel 62*b* as shown in FIG. 5, are instead rotatably supported by the support 63, and therefore their respective rotation axes are adapted to move together with it.

A helical spring 66 (FIG. 8*a*) having a conical shape, acts to exercise pressure between the lever support 63 and the gear 62*b* to develop sufficient friction strength between the respective contacting surfaces so that the lever support 63 is pulled in the same rotation direction around axis 64 of gear 62*b*, when this is rotated in one direction or the other by the motor 19.

In this manner, or in other words, according to the rotation direction of the main driving motor 19, the toothed wheels 62*a* and 62*d* positioned at the extremities of the set of gears of the driving mechanism 60, can be selectively moved to mesh, either one or the other, with the drive gear 54 of the leafing member 50, as will be explained more clearly further on, with the description of the functioning of device 10.

The leafing device 10 to extract and feed sheets from two trays 20 and 30 is also associated with a support or insertion surface 70 (FIGS. 1, 7*a*, and 7*c*) that is integral with the fixed structure 15 of the fax machine 11, and that is positioned in front of the second tray 30, when viewed from the side of the leafing member 50.

In the more general context of the functioning of the fax machine 11, the insertion surface 70 acts to receive a single document sheet 71 (FIG. 7*c*) that is intended to be fed and read immediately by the reading device 13 and to be transmitted immediately by the fax 11, even when the other sheets of document 31, to be transmitted, are already present in the second tray 30.

For this purpose, the insertion surface 70, is directed basically in a parallel direction with the first and second tray 20 and 30, and extends in the lower part adjacent to the reading unit zone 13, between the traction roller 13*b* and the reading bar 13*a*.

The leafing device 10 and more generally, the fax machine 11 also comprise a sensor system, with commonly known characteristics, and therefore for simplicity not included in the drawings, which act to detect the presence of the sheets in the various trays of the leafing device 10, as well as their passage along the feeding path 18, in order to correctly control the general functioning as well as the specific operations performed by the fax machine 11. More in detail, a first and a second presence sensor are associated in order with the second tray and with the insertion surface 70 to detect the presence or absence of one or more document sheets 31, and of a single document sheet 71, respectively in the second tray 30 and on the insertion surface 70.

Again, a further sensor is positioned along the path 18 to detect the passage of the front edge of a sheet 21 or 31 coming respectively from tray 20 or 30 in order to control the further feeding of the sheet 21 or 31 correctly, until it is expelled externally from the fax machine 11.

Functioning of the Leafing Device of the Invention

The functioning of the leafing device 10 of the invention will now be described in detail with reference to the flow diagram in FIGS. 9*a* and 9*b* distinguishing between the case in which the leafing device 10 feeds a copy sheet 21 from the first tray 20, and the case where the leafing device 10 feeds an original or document sheet 31 from the second tray 30.

Leafing Cycle of a Copy Sheet

To begin, this cycle provides that a ream of blank sheets 21 is present in the first tray 20, whereas no sheets to be transmitted are present in the second tray 30.

In fact, if sheets 31 are present in the second tray 30, this will be signalled by the sheet presence sensor associated with the second tray 30, and therefore in response the program operating the fax machine 11 will give priority to the transmission of the document to be sent, over the reproduction of the document in arrival.

Therefore in this case the operating program would activate one or more feeding cycles of a sheet 31 from the second tray 31 exactly identical to that described previously until all sheets 31 have been sent from the second tray 30.

Figure 7A:
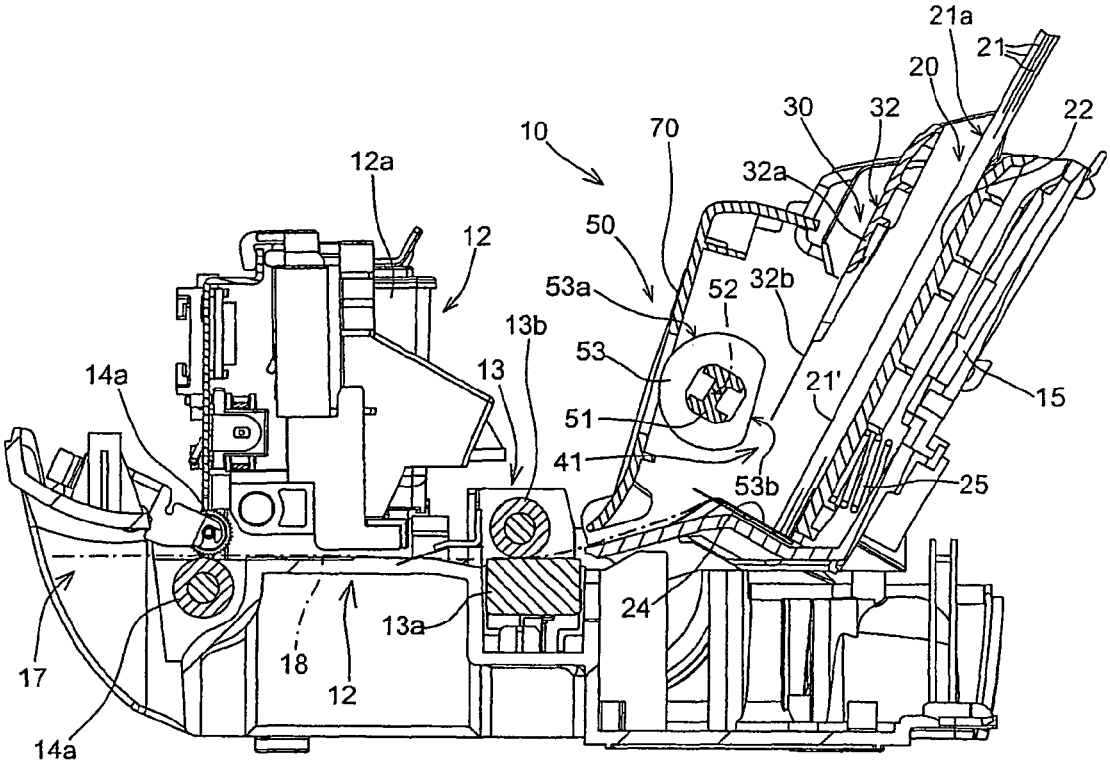
FIG. 7*a* is a first cross-section view that shows the leafing device shown in FIG. 1 in an initial operating condition, at the beginning of a feeding cycle of a sheet from a first one of the two trays.
Figure 7B:
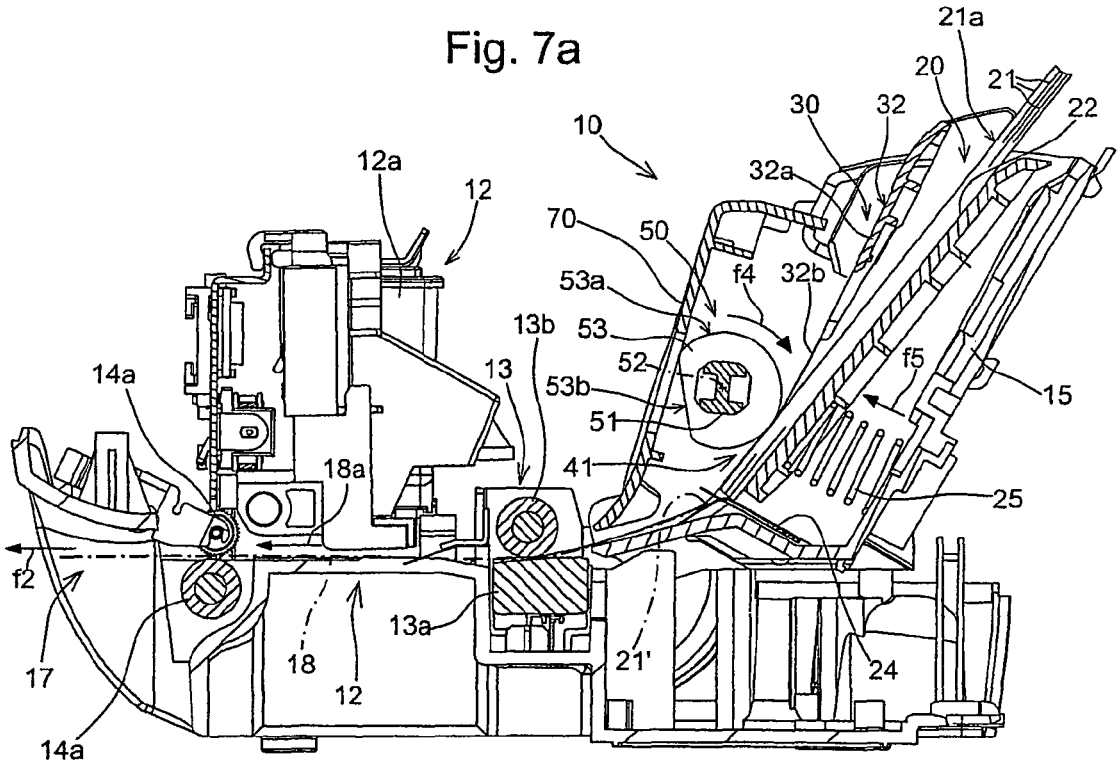
FIG. 7*b* is a second cross-section view that shows the leafing device shown in FIG. 7*a* in a successive operating condition, during the feeding cycle of the sheet from the first tray.

In the initial situation, the leafing member 50 is arranged in a determined angular position around axis 52, represented in FIG. 7*a*, and also referred to as initial or zero position, at which the two leafing rollers 53 have their respective flat surfaces 53*b* facing and basically parallel to the surface of the fixed wall 32 of the second tray 30.

Moreover, also corresponding to this initial setting of the leafing member 50, the main drive gear 54, fixed at the extremity of the same leafing member 50, is positioned in an angular manner so as to have the un-toothed portion 54*b*, facing the extremity gear 62*d* of the rocker mechanism 60.

The rocker member 61, in turn, is arranged in a position, at the end of its angular travel distance around the fixed axis 64, at which gear 62*a* is detached and therefore not meshed with the toothing 54*a* of the drive gear 54.

Consequently it occurs that in the initial setting, the leafing member 50 is idle, or in other words, is not engaged with the driving mechanism 60.

Again, still in this initial setting, the shaft 51 of the feeding member 50 is arranged in a determined angular position at which the two cam profiles 56 cooperate at the top in contact with the respective cooperation elements 22*a* integral with the mobile wall 22 as shown in FIGS. 4 and 7*a*, in order to maintain and block the mobile wall 22 of the first tray 20 in a retracted position with respect to the feeding member 50, to counter the action of the elastic means 25 which act to constantly push against the mobile wall 22 in a direction towards the rollers 53.

This retracted position of the mobile wall 22 of the first tray 20 also permits the easy insertion of the first ream 21*a* into the first tray 20 from above, so that ream 21*a* is in side contact with the mobile wall 22 and along the lower edge of the striking surface 24.

Figure 9A:
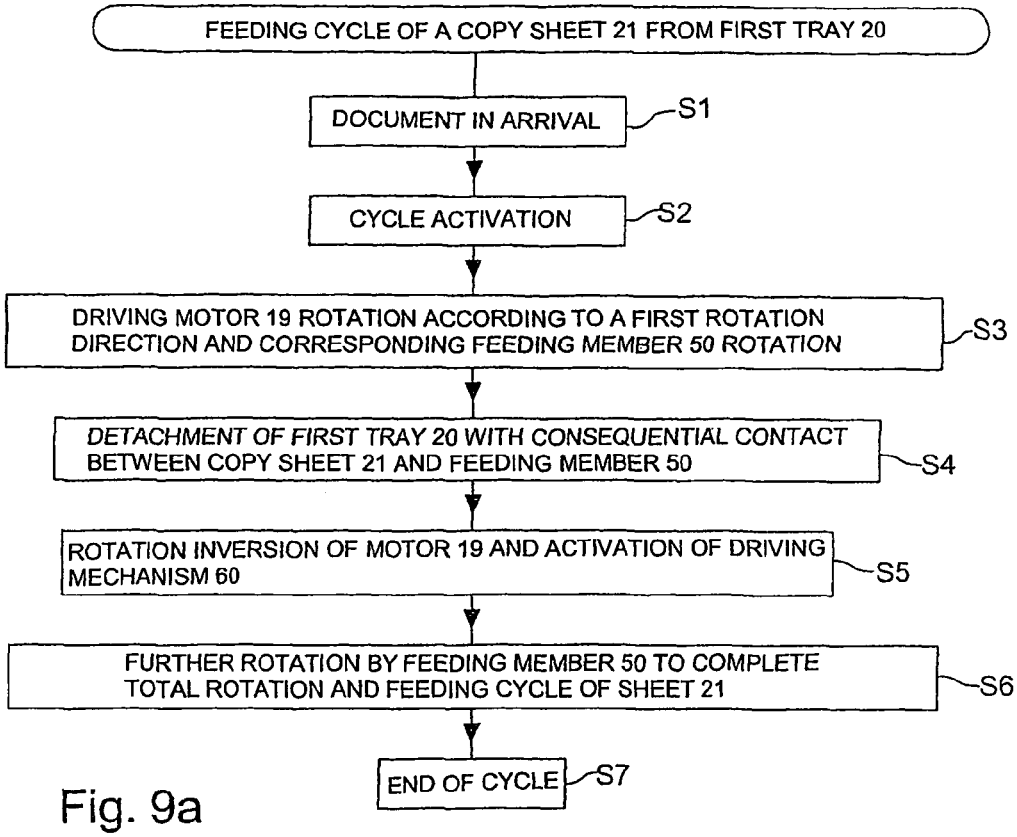
FIGS. 9*a*-9*b* are two flow charts relating to two extraction cycles of a sheet performed by the leafing device shown in FIG. 1, from the first and second tray respectively.
Figure 9B:
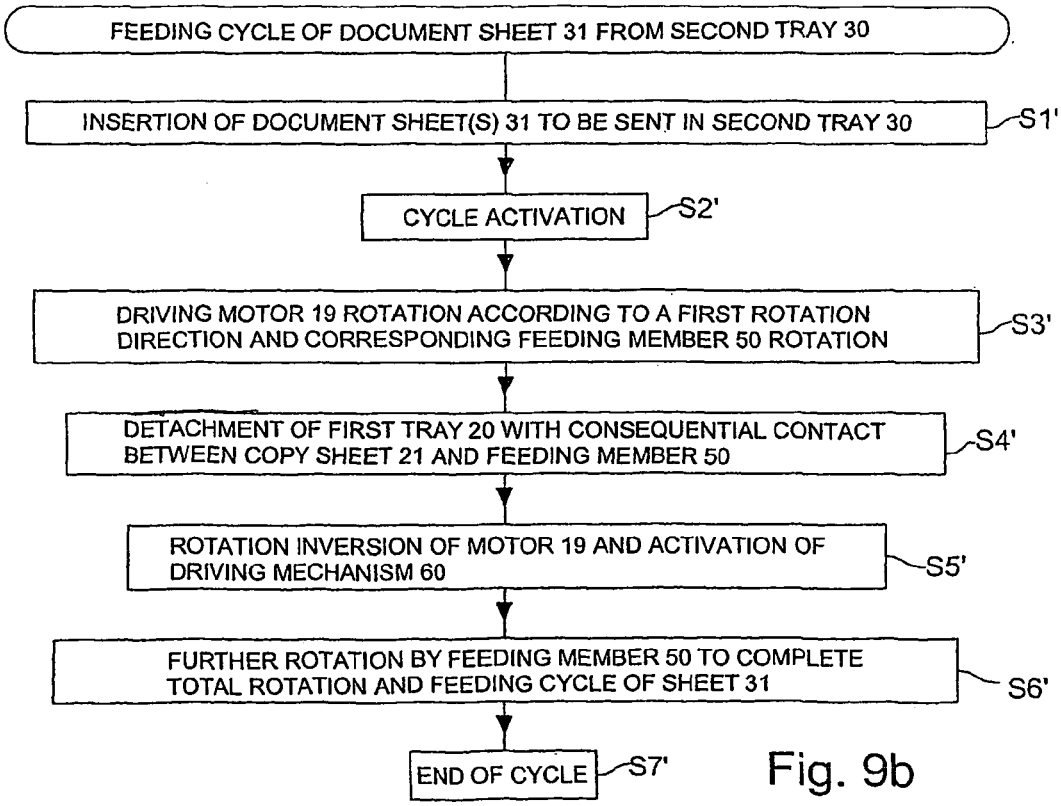

At a certain moment, as shown in step S1 in the flow diagram in FIG. 9*a*, the fax machine 11 receives a signal through the external line that a document is about to be received and must be reproduced.

Therefore, in response, as shown in step S2, the fax 11 activates the printing procedure for a copy sheet 21 to reproduce the received document.

In particular during step S3, and as shown in FIG. 5, the fax 11 drives a rotation of the main motor 19 to determine a corresponding rotation in a clockwise direction of the central gear 62*b* of the mechanism 60.

In turn, the clockwise rotation 62*b* provokes a corresponding clockwise rotation through friction, around axis 64 of gear 62*b* of support 63 together with the set of gears supported by the same support 63.

Therefore, because of the clockwise rotation of support 63, the extremity gear 62*a* is moved so that it engages and meshes with the toothed portion 54*a* of gear 54, thus activating the rotation thereof, while the said toothed wheel 62*a*, driven by toothed wheel 62*b*, rotates in an anticlockwise direction.

Thus, gear 54 begins to rotate in a clockwise direction, and therefore also the leafing member 50, starting from the initial position shown in FIG. 7*a*, coherent with the extraction and feeding direction of the sheets 21 along path 18.

The rotation of motor 19 continues until it drives a determined angular rotation of shaft 51, in a clockwise direction as shown by an arrow f4 (FIG. 7*b*) to determine the release of the cam profiles 56 from the cooperating elements 22*a* of the wall 22.

Therefore in this manner, during step S4, the mobile wall 22 of the first tray 20 is released from the cam profile 56 and under the thrust created by the elastic means 25, it rotates around the fulcrum 23 towards the feeding member 50 as shown by an arrow f5, thus bringing the uppermost sheet 21' on the top of the ream 21, into contact with the two rollers 53 of the leafing member 50, which, in the meantime, have turned in a clockwise direction in order to present, for contact with the uppermost sheets 21', their respective cylindrical surfaces 53*a*.

It is also clear that the contact and cooperation between the two rollers 53 and the sheet 21' occurs through and thanks to the presence of the opening 41 formed by the fixed wall 32 of the second tray 30.

In order to prevent sudden movement by the mobile wall 22 during this step S4, each cam profile 56 is equipped with an auxiliary profile 56*a* which is configured to cooperate with a corresponding guide profile 57 (FIG. 8*c*) supported in a mobile manner by structure 15, and in turn adapted to accompany the mobile wall 22 as it rotates around the fulcrum 23 towards the leafing member 50, following the release from the cam profiles 56.

At the same time, on completion of the programmed rotation of the motor 19 according to the first rotation direction, in other words immediately after having detached the tray 20 from the profiles 56, and therefore determined the contact between the feeding rollers 53 and the uppermost sheet 21', the fax driving unit 11 drives, as shown by step S5, an inversion of the motor 19 rotation direction, which then begins to rotate according to a second rotation direction, opposite to the first direction.

In this manner, motor 19 drives a rotation of the central toothed wheel 62*b* in an anti-clockwise direction, and therefore a corresponding rotation, still in an anti-clockwise direction, of the rocker support 63 around the axis 64 of the toothed wheel 62*b*, with the consequential detachment of toothed wheel 62*a* from the drive gear 54 and the simultaneous meshing of the other extremity toothed wheel 62*d* with said gear 54, which in the meantime has rotated in a clockwise direction (FIG. 5) with respect to its initial position, in order to present the toothed portion 54*a* for meshing with the toothed wheel 62*d*.

As it can be seen easily in FIG. 5, the set of gears 62*a*-62*d* is configured so that after the toothed wheel 62*d* is meshed with the drive gear 54, and while the central toothed wheel 62*b*, driven by motor 19 continues its anti-clockwise rotation, the drive gear 54 continues to rotate in the same clockwise direction as before when it was commanded to rotate by the toothed wheel 62*a*.

Moreover, the transmission ratio of the toothed wheel train 62*a*-62*d* is dimensioned so that the rotation of gear 54 continues not only in the same previous clockwise direction, but also at the same previous angular speed.

As indicated in step S6, the rotation of drive gear 54 continues in a clockwise direction until the relative un-toothed portion 54*b* faces again the toothed wheel 62*d*.

Therefore, during this step, the two feeding rollers 53 continue to rotate in the clockwise direction as shown by the arrow f4 (FIG. 7*b*) and also coherent with the travel direction 18*a*, to engage the uppermost sheet 21' on top of the ream 21, by means of the respective cylindrical portions 53*a* in order to separate the uppermost sheet 21' from the other sheets in the ream 21*a* and to feed it along the feeding path 18.

Figure 8A:
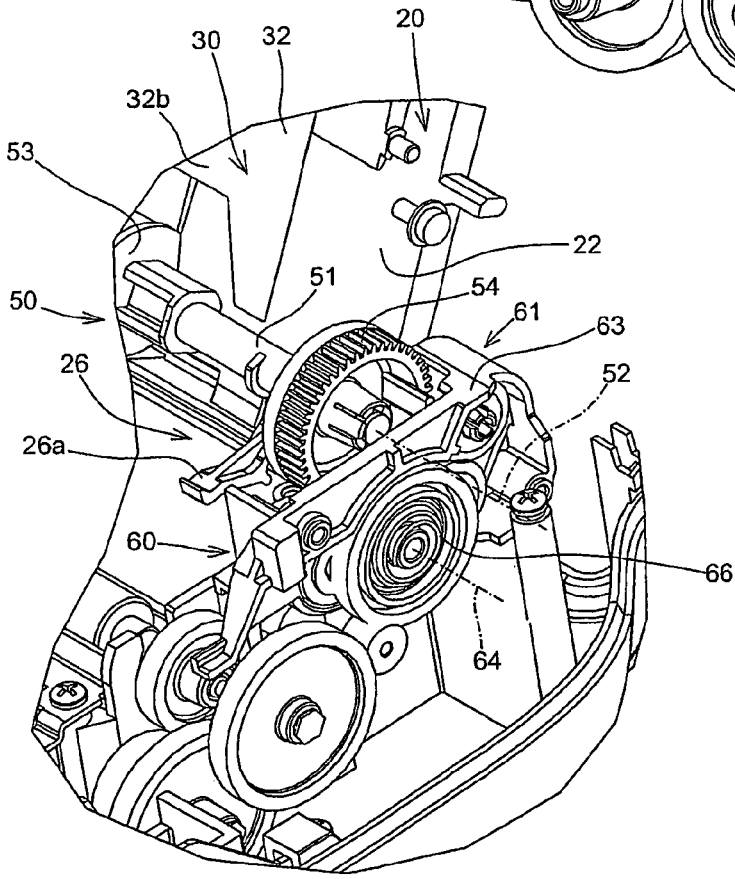
FIGS. 8*a*-8*c* show perspective enlarged views of certain details of the leafing device of FIG. 1.
Figure 8B:
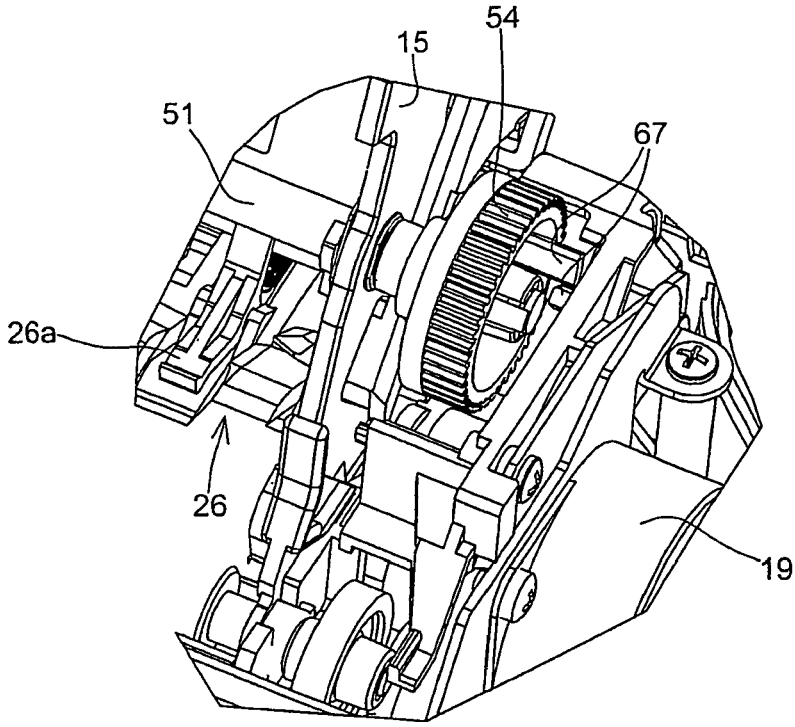
Figure 8C:
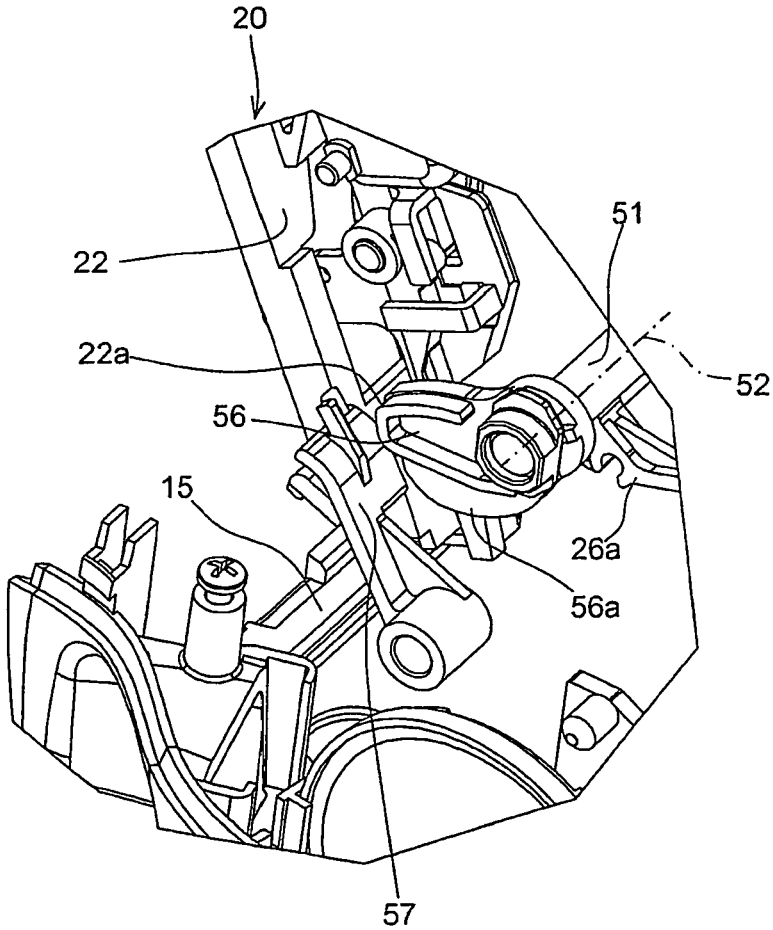

Suitably, the support 63 of the driving mechanism 60 and gear 54 are equipped with respective guide profiles 67, shown in FIGS. 8*a* and 8*b* that are intended to cooperate reciprocally for the purpose of preventing that, because of the stress induced by the force necessary to separate and pull the uppermost sheet 21', a disengagement and, thus a detachment, starts and occurs between the toothing 54*a* of the main drive gear 54 and the gear 62*d* along the angular rotation section of gear 54 which corresponds with the engaging step between the leafing member 50 and the uppermost sheet 21' of ream 21*a*.

Then, on completion of a total rotation by the leafing member 50, when the portion 54*b* of the drive gear 54 is facing the toothed wheel 62*d*, disengagement occurs between the toothed wheel 62*d* and gear 54, causing the gear 54 to stop rotation immediately, and thus the feeding cycle of the sheet 21' from tray 20 is also arrested, as shown in step S7.

At this point of the cycle, the two feeding rollers 53 present the respective lowered portions 53*b* facing sheet 21' which in this manner is released from the leafing member 50.

Meanwhile however, the front part or top of sheet 21' has travelled sufficiently far along the path 18 to be gripped by the rotating members 14*a* of the feeding means 14, and to travel further even after the release from the leafing member 50 of device 10.

In particular, these rotating members 14*a* are driven to rotate, according to the feeding direction 18*a*, by motor 19 which rotates in the second rotating direction, activated after the release of tray 20 from the cam profiles 56.

Therefore, during this step, the motor 19 continues to rotate according to this second rotation direction, without however activating the device 10 in any way, which remains in an idle or rest mode, while the sheet 21' travels further along the path 18.

In this manner the sheet 21' passes in front of the printing unit 12 to be printed and therefore to reproduce the received document, and then after printing, it is expelled from the fax machine 11 as shown by arrow f2.

Then a new leafing cycle begins, identical to that described above, of a new sheet 21 from the tray 20, and so on until the document received from the fax 11 has been printed completely.

Leafing Cycle of a Document Sheet

Figure 7C:
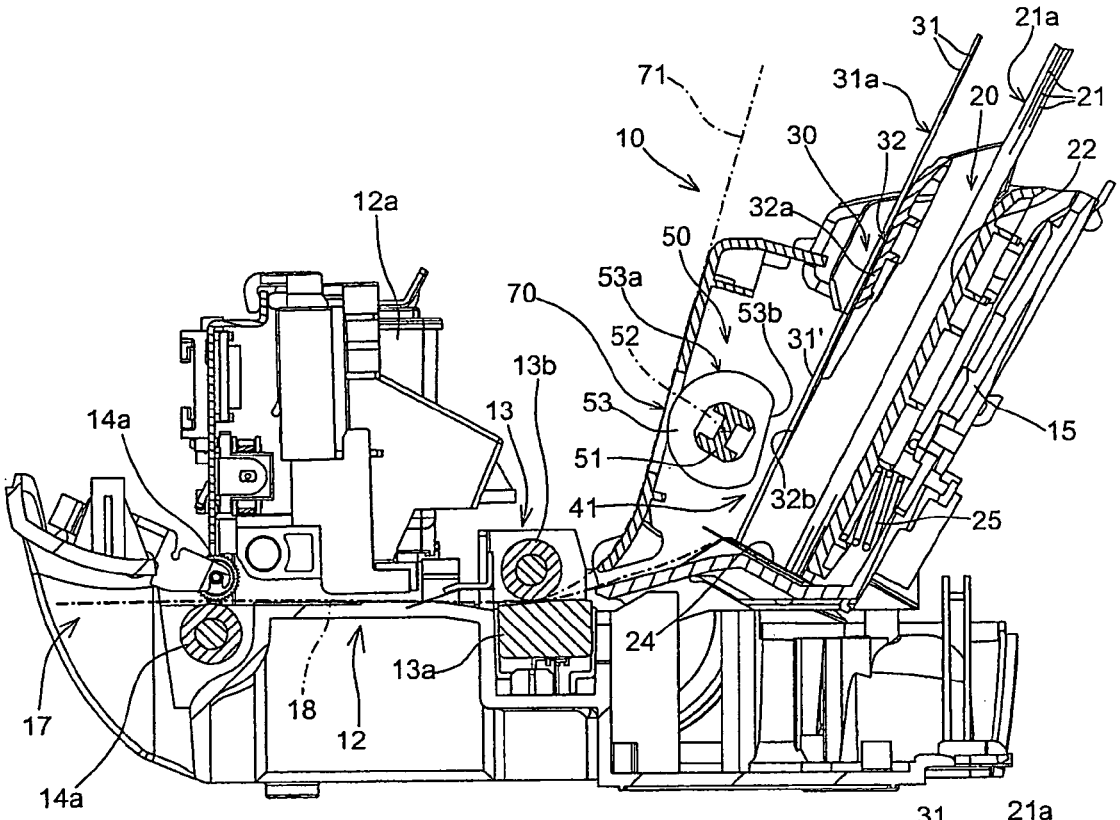
FIG. 7*c* is a third cross-section view that shows the leafing device shown in FIG. 1 in an initial operating condition, at the beginning of a feeding cycle of a sheet from a second one of the two trays.

In the start-up situation shown in FIG. 7*c* just before the leafing cycle of any document sheet 31 from the second tray 31 the leafing member 50 is arranged in an angular manner around axis 52 in the same initial setting previously foreseen for the leafing cycle of a copy sheet 21, in other words, with the cylindrical portions 53*a* of rollers 53 positioned in the zone opposite that of trays 20 and 30, and with the flat portions 53*b* of rollers 53 positioned basically parallel to and facing the walls 22 and 32 of the two trays 20 and 30.

Therefore in this initial setting, the leafing rollers 53 are positioned in an angular manner to prevent interference and to leave the space for the second tray 30 free, to permit the insertion from above into the second tray 30 of the sheets 31 to be transmitted.

Also consequently in the initial setting, as for the leafing cycle of sheet 21 from the first tray 20, the gear 54 of the leafing member 50 is free, and facing the gear 62*d* at the un-toothed portion 54*b*, and therefore it is not gripped with the driving mechanism 60.

Lastly, still in said initial setting, as seen previously in the leafing cycle from the first tray 21, the shaft 51 of the feeding member 50 is arranged in a determined angular position at which the two cam profiles 56 cooperate at the top in contact with the respective cooperating elements 22*a* integral with the mobile wail 22, as shown in FIGS. 4 and 7*c* thus maintaining and blocking the mobile wall 22 of the first tray 20 in a retracted position, with respect to the feeding member 50, to counter the action of the elastic means 25 that push constantly against the wall 22 in the direction of rollers 53.

In this initial situation and at step S1' (FIG. 9*b*), the user using the fax machine 11 inserts into the second tray 30, closest to the feeding member 50, one or more original sheets 31 which compose the document to be transmitted by fax 11 and form, after insertion, a ream 31*a* that leans sideways on wall 32 of tray 30 and at the bottom on the striking surface 24 common to both trays 20 and 30.

The presence of said sheets 31 in the second tray 30 is immediately signalled by the presence sensor associated with said tray 30, and consequently the fax machine 11 is arranged to read and transmit the sheets 31 introduced in the second tray 30.

At this point the user physically activates, for example by pressing a button on the fax 11, the document transmission procedure corresponding with sheets 31 inserted in the second tray 30, and in response the fax 11 commands a first leafing cycle from the second tray 30, as shown in step S2'.

In particular, in a similar manner to that of the leafing cycle of copy sheet 21 from the first tray 20, the driving unit of fax 11 drives, during step S3', a rotation of the motor 19 to determine the clockwise rotation by friction of the central toothed wheel 62*b*, that in turn determines a corresponding clockwise rotation of the lever support 63, around axis 64 of the toothed wheel 62*b*, in order to bring the extremity toothed wheel 62*a* to mesh with toothing 54*a* of the drive gear 54.

Then the leafing cycle of the second tray 30 continues in the same manner previously described with reference to the leafing cycle of the first tray 20.

Therefore, after the clockwise rotation of shaft 51, the cam profiles 56 disengage from the first tray 20, that is thus released and detached, as shown in step S4'.

In response, the mobile wall 22 of tray 20 reacts under the thrust of the elastic means 30, rotating in a clockwise direction around fulcrum 23 towards the leafing member 50 in the direction shown by the arrow f5 (FIG. 7*d*) in order to push and engage the ream 31*a* contained in the second tray 30, against the leafing member 50.

Figure 7D:
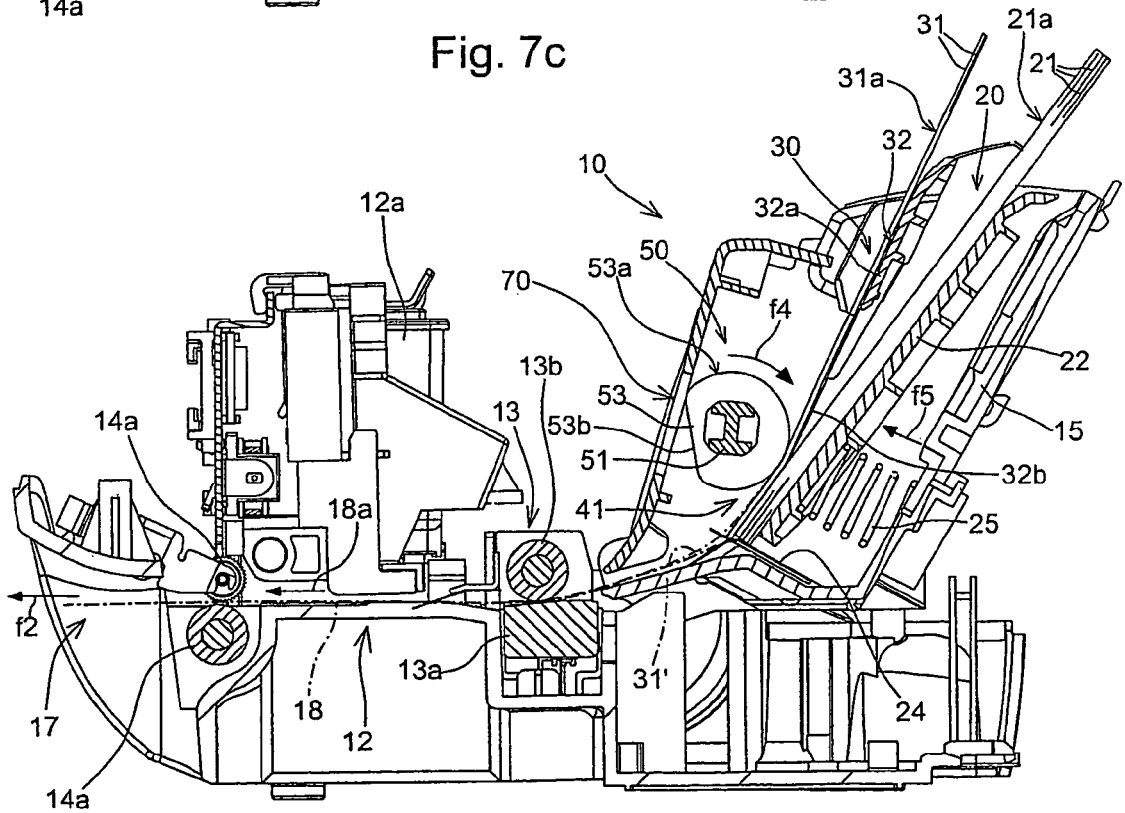
FIG. 7*d* is a fourth cross-section view that shows the leafing device shown in FIG. 7*c* in successive operating condition, during the feeding cycle of the sheet from the second tray.

In more detail, the mobile wall 22 of tray 20, either directly if no sheet 21 is present in tray 20, or indirectly, by means of any sheets of a possible ream 21*a* contained in tray 20, cooperates at the opening 41 making contact with the rear end of ream 31*a* contained in tray 30, to press an uppermost sheet 31' arranged on the opposite side of ream 31*a*, against the feeding rollers 53 of the leafing member 50, which in the meantime are rotated in order to have the respective cylindrical portions 53*a* for contact with the uppermost sheet 31', as shown in FIG. 7*d*.

At this point, in a manner totally identical to that of the feeding cycle of sheet 21' from the first tray 20, during step S5', the fax 11 commands an inversion of the rotation direction of motor 19, said inversion in turn provokes the detachment of the toothed wheel 62*a* from gear 54 and instead, brings the gear 54 to engage with the other toothed wheel 62*d*, and therefore gear 54 together with the feeding rollers 53 continue to rotate in a clockwise direction as shown by arrow f4 to extract the uppermost sheet 31' on top of ream 31*a*, and to feed it along the feeding path 18 in the direction 18*a*.

The feeding cycle then continues during step S6', once again in the same way described with reference to the extraction and feeding cycle for uppermost sheet 21', until, on completion of one rotation of shaft 51, i.e. at the end of the cycle (step S7'), the sheet 31' disengages from the feeding rollers 53 to be engaged by the rotating members 14*a* of the feeding means 14.

In this manner sheet 31' travels further along the path 18 in order to be read completely by the reading unit 13, and then it is released at the exit of the fax 11.

The leafing cycle described above is repeated in an identical manner for each sheet 31 that remains in tray 30 to be transmitted, until all sheets 31 have been picked up from second tray 30.

Feeding Cycle of a Single Sheet to be Transmitted with Priority

Whenever the need arises to transmit a single document sheet 71 by fax 11 with priority over any other operations underway on fax 11, the user inserts the sheet 71 to be transmitted through a slot formed on the external case of the fax 11 so that it is laid on surface 70 as shown by the dashed and dotted line in FIGS. 1 and 7*c*.

In this situation, the feeding member 50 is positioned in the same initial setting previously described with respect to the extraction and feeding cycles for sheets 21 and 31 respectively from the first tray 20 and the second tray 30.

To make the concept clearer, it must be remembered that in this initial setting, as shown in FIG. 5, the drive gear 54 has the un-toothed portion 54*b* facing the extremity toothed wheel 62*d*, while toothed wheel 62*a*, arranged on the opposite extremity of the rocker member 61, is detached and disengaged from gear 54 so that drive gear 54 is disengaged from the rocker mechanism 60.

Once it is inserted into the fax 11, the document 71 is placed on support surface 70 with the lower part of the sheet 71 adjacent to the traction roller 13*b* of the reading unit 13.

The presence of sheet 71 is immediately signalled by the sensor associated with the surface 70, and therefore the fax 11 immediately prepares itself for reading and transmitting the single document sheet 71 that has been inserted.

At this point the user activates the feeding cycle of sheet 71, for example by pressing a button on the fax 11.

The driving motor 19 is then activated to drive and rotate the traction roller 13*b*, so that sheet 71 is gripped between the roller 13*b* and the reading bar 13*a*, and travels in the direction 18*a* to be read progressively by the reading unit 13.

During this step, in order to drive the rotation of the traction roller 13*b*, and of the other feeding rollers 14*a* intended to feed sheet 71 along direction 18*a*, motor 19 rotates according to a determined direction, also called interlinear, that in turn corresponds with an anticlockwise rotation of the central toothed wheel 62*b*.

At this point, as is easily seen on FIG. 5, this anticlockwise rotation by the central toothed wheel 62*b* is such, that it does not provoke any meshing between the toothed wheels of the rocker member 61 and the drive gear 54, and thus, the mechanism 60 does not intervene to connect in rotation the leafing member 50 with motor 19.

In other words, during this step, unlike the feeding cycle for sheets 21 and 31 from the respective trays 20 and 30, the lever support 63 is not driven and induced to rotate in a clockwise direction around axis 64 to bring the central toothed wheel 62*a* to mesh with gear 54.

On the contrary, the lever support 63 remains in its current position, at the end of its angular course around axis 64, and therefore the toothed wheel of extremity 62*a* rotates idly detached from the toothed portion 54*a* of gear 54, and the other extremity toothed wheel 62*d* also rotates idly in the zone of the un-toothed portion 54*b*.

Therefore, the gear 54 remains still in its initial position with the result that it does not activate any sheet extraction from tray 20 or from tray 30.

In the meantime, motor 19 continues to rotate for a determined number of turns—still according to the interlinear direction, to feed sheet 71 further along the path 18.

In this manner, sheet 71 transits for its entire length in front of the reading bar 13*a* so that it is read, and lastly after the reading action, it is expelled from the fax 11.

At this point, the motor 19 is in a stop position, and therefore device 10 is once again in the initial setting ready to perform a new extraction cycle on sheets 21 or 31 respectively from the first or second trays 20 or 30, or on a single sheet 71 from the support surface 70.

The cycle described above is repeated each time a single document sheet 71 is inserted on surface 70.

Variants

Alternative embodiments of the present invention are possible. Among these, some are described below.

As an alternative to the embodiment described above, the cooperation between the feeding member and the first ream, in order to extract a sheet from the first ream, can be performed without any actual physical contact between the feeding member and the first ream, for example by means of forces applied by the feeding member of the type that acts through the second tray, such as pneumatic forces associated with pressurised or suction air flow, or even by means of electrostatic type force.

Furthermore, in a different embodiment, the leafing cycle can also not necessarily correspond with a complete rotation of the leafing roller: for example, the leafing cycle can be performed without the use of a D-shaped un-faced roller, or can be activated by driving motor rotation, without rotation inversion.

Once again, instead of having the leafing member rotating around a fixed axis and at least one of the two trays mobile with respect to the leafing member, to bring the reams contained in the two trays to engage with the leafing member, it is possible to fix both trays to the leafing member which then moves with respect to the trays to cooperate in contact with the respective reams.

The invention claimed is:

1. Device for extracting and feeding sheets comprising:

a first tray and a second tray adapted to contain respectively a first ream of sheets and a second ream of sheets, a feeding member driven by a driving mechanism to selectively pick up and drag a sheet one at a time from said first ream of sheets in the absence of the second ream of sheets in said second tray, or from said second ream of sheets in the presence of the second ream of sheets in said second tray, said second tray being positioned between said first tray and said feeding member and comprising a cooperating zone between the first tray and the feeding member, wherein said feeding member comprises:

a first portion arranged to be engaged by said driving mechanism, and a second portion arranged to be disengaged from said driving mechanism;

wherein said first portion and said second portion are coplanar and determine a feeding position and an idle position, respectively, of said feeding member, and wherein said driving mechanism comprises a rocker mechanism supporting a first gear and a second gear that are coplanar, wherein the rocker mechanism is arranged to oscillate around a fixed axis to engage the first gear or the second gear with the first portion of said feeding member to drive said feeding member in only one direction to selectively pick-up and drag sheets from one of the first and second trays.

2. Device according to claim 1, wherein said cooperating zone comprises an opening to permit, in the absence of the second ream in said second tray, said feeding member and said first ream contained in said first tray to become engaged reciprocally.

3. Device according to claim 2, wherein said first and said second tray are positioned on top of one another on the same side of said feeding member and said opening is formed by a fixed wall of said second tray adapted to receive and support in contact said second ream.

4. Device according to claim 2, wherein in the presence of said second ream contained in said second tray, said opening is such that it permits said first tray to operate on said second ream to press and maintain it engaged against said feeding member.

5. Device for extracting and feeding sheets according to claim 1, comprising a support structure for said first and said second tray, wherein said first tray is mobile, and in particular fulcrum mounted on said support structure and said second tray is fixed and integral with said support structure.

6. Device for extracting and feeding sheets according to claim 5, wherein said feeding member comprises at least one feeding roller rotating around a fixed axis on said support structure and wherein elastic means are associated with said first tray to push it towards said feeding member in order to engage an uppermost sheet from said first or second ream with said feeding roller.

7. Device for extracting and feeding sheets according to claim 6, wherein said driving mechanism is adapted to drive in an incremental manner, a complete rotation of said feeding roller, in order to determine, at each complete rotation, the extraction and feed of a sheet from said first ream contained in said first tray or from said second ream contained in said second tray.

8. Device for extracting and feeding sheets according to claim 7, wherein said feeding roller is of the type having, along the development of an round angle that corresponds with a complete rotation of said feeding roller, a first cylindrical portion configured according to an external cylindrical profile, and a second lowered portion, connected to said first cylindrical portion and configured according to a lowered profile with respect to said external cylindrical profile.

9. Device according to claim 7, wherein said driving mechanism is adapted to drive said feeding roller by means of a drive gear that rotates integrally with said feeding roller and having externally a first toothed portion and a second un-toothed portion wherein said second un-toothed portion, is intended to be positioned in front of a toothed wheel of said driving mechanism on completion of said total rotation, in order to cause the arrest of said feeding roller in a position wherein the relative lowered portion is facing and basically parallel to said second tray.

10. Device according to claim 5, further comprising a further driving mechanism adapted to cooperate in contact with a lower edge of at least one of said first and said second ream contained in said first and said second tray so that said lower edge constantly follows and does not detach from said first tray when the latter moves backwards and forwards with respect to said feeding member.

11. Device for extracting and feeding sheets according to claim 1, further comprising an additional support surface to receive single sheets wherein said driving mechanism is arranged to directly drive said single sheet when said feeding member is in said idle position.

12. Fax machine comprising a device for the separation and feeding of sheets according to claim 1, wherein, said first ream is composed of blank sheets intended to be printed to reproduce a document received through said fax machine, and said second ream is composed of original sheets intended to be read and to be transmitted by said fax machine.

13. Method for the selective feeding of sheets from a first ream or a second ream, comprising:

housing at least one of said first ream and said second ream, respectively, in a first tray and in a second tray, said second tray being positioned above said first tray;

extracting a sheet from one of said first and second ream with a feeding member having a first portion and a second portion that are coplanar, said second tray comprising a cooperating zone between the first tray and the feeding member, said step of extracting a sheet comprising selectively extracting a sheet from said second ream in presence of said second ream in said second tray, or extracting through said cooperating zone a sheet from said first ream in the absence of said second ream in said second tray; and engaging the first portion of the feeding member with a first gear or a second gear of a rocker-type driving mechanism to drive the feeding member, or engaging the second portion of the feeding member with the first gear or the second gear of the rocker-type driving mechanism to not drive the feeding member, wherein the first gear and the second gear are coplanar.

14. Method according to claim 13, further comprising extracting a sheet from one of said first ream and said second ream through a cooperating zone comprising an opening in said second tray.

15. Method according to claim 13, wherein extracting a sheet from one of said first ream and said second ream comprises using at least one feeding roller adapted to perform a complete rotation that corresponds with an extraction cycle of said sheet, said feeding roller having externally a first cylindrical portion, adapted to cooperate in contact with said sheet, and a second portion lowered with respect to said cylindrical surface, adapted to place itself facing and spaced from said first or said second ream after said total rotation, on completion of the extraction cycle of said sheet.

* * * * *